United States Patent [19]

Egli et al.

[11] Patent Number: 4,597,526

[45] Date of Patent: Jul. 1, 1986

[54] PROCESS AND APPARATUS FOR THE SUPERFINE SPRAYING OF SUSPENSIONS

[75] Inventors: René Egli, Sins; Hans-Rudolf Staub, Eggenwil, both of Switzerland

[73] Assignee: Lonza Ltd., Gampel, Switzerland

[21] Appl. No.: 527,405

[22] Filed: Aug. 29, 1983

Related U.S. Application Data

[63] Continuation-in-part of Ser. No. 260,610, May 5, 1981, abandoned.

[30] Foreign Application Priority Data

May 13, 1980 [CH] Switzerland ..... 3725/80
Jul. 6, 1983 [CH] Switzerland ..... 3700/83

[51] Int. Cl.[4] ..... B05B 15/02

[52] U.S. Cl. ..... 239/123; 239/290; 239/424.5

[58] Field of Search ..... 239/123, 1, 8, 11, 114–118, 239/290–301, 424, 424.5, 429, 433, 9

[56] References Cited

U.S. PATENT DOCUMENTS

| | | | |
|---|---|---|---|
| 1,486,685 | 3/1924 | Reinhardt . | |
| 1,507,139 | 9/1924 | Pike . | |
| 1,980,464 | 11/1934 | Yedd | 299/140 |
| 2,179,184 | 11/1939 | Hodge | 239/118 |
| 2,809,866 | 10/1957 | Vessels | 239/9 |
| 2,890,836 | 6/1959 | Gusmer et al. | 239/117 |
| 3,083,913 | 2/1963 | Coffman et al. | 239/150 |
| 3,584,789 | 6/1971 | Traynor | 239/106 |
| 3,857,511 | 12/1974 | Govindan | 239/11 |
| 4,146,179 | 3/1979 | Egli et al. | 239/106 |
| 4,171,091 | 10/1979 | Hardeveld et al. | 239/8 |
| 4,179,068 | 12/1979 | Dombrowski | 239/290 X |

FOREIGN PATENT DOCUMENTS

| | | |
|---|---|---|
| 2724931 | 12/1977 | Fed. Rep. of Germany . |
| 569852 | 4/1924 | France . |
| 1009184 | 11/1965 | United Kingdom . |
| 1059690 | 2/1967 | United Kingdom . |
| 1140442 | 1/1969 | United Kingdom . |
| 1160957 | 8/1969 | United Kingdom . |
| 1359439 | 7/1974 | United Kingdom . |
| 1374200 | 11/1974 | United Kingdom . |

*Primary Examiner*—Andres Kashnikow
*Attorney, Agent, or Firm*—Fisher, Christen & Sabol

[57] ABSTRACT

Process and apparatus for the superfine spraying of suspensions which tend to form films and resinificate upon contact with air. An example of such suspensions are the suspensions for spraying high temperature lubricants formulated on a graphite basis with additions of alkylene polymerizates to a dispersion agent. The apparatus has a spray head with a nozzle opening, a die which can be pushed through the nozzle opening and a sieve insert. The suspension is sprayed in the most finely distributed form through an air atomizer nozzle by means of a pressure gas which is oversaturated or saturated with a liquid.

5 Claims, 4 Drawing Figures

PROCESS AND APPARATUS FOR THE SUPERFINE SPRAYING OF SUSPENSIONS

This is a continuation-in-part of U.S. application Ser. No. 260,610, filed on May 5, 1981, now abandoned.

BACKGROUND OF THE INVENTION

1. Field of the Invention

The invention relates to a process and an apparatus for the superfine spraying of dispersive systems in superfine particle form.

2. Prior Art

German OS No. 27 24 931 discloses an apparatus for the spraying of dispersed systems, especially suspensions. The apparatus contains a dispensing head having an orifice nozzle, a die disposed inside of the dispensing head and shiftable through the orifice nozzle aperture and possibly a sieve insert bottom disposed between an inlet for the dispersive system and the orifice nozzle, with a stripping arrangement for the sieve insert. In order to operate satisfactorily with such apparatus and in order to obtain a uniform spray pattern, it is necessary to maintain a minimum orifice nozzle diameter of 0.3 mm and a minimum operating pressure of 20 bar. Such means that successful operation cannot be obtained if the throughput goes below a certain value. Such also means that, in the case of spraying, the dispersive systems are applied as relatively thick films.

When spraying suspensions containing graphite as a dispersing material, larger portions of polymers such as alkylene polymerizates, dispersants and stabilizers, suspended as a rule in water, through an air atomizing nozzle, there exists the danger that the polymer especially tends to form a film and resinificate. Such suspensions are described in German OS No. 24 50 717 as high temperature lubricants.

BROAD DESCRIPTION OF THE INVENTION

An object of the invention is to provide processes and apparatus which overcome the above-stated disadvantages of the prior art. Other objects and advantages of the invention are set out herein or are obvious herefrom to one ordinarily skilled in the art.

The objects and advantages of the invention are achieved by the apparatus and processes of the invention.

The first embodiment of the invention involves an apparatus for spraying dispersive systems in the most-finely or very finely distributed form. The apparatus includes a dispensing head having an orifice nozzle (13), a die (14) disposed inside of the dispensing head and shiftable in front of the orifice nozzle aperture, and a mesh bottom insert (16) disposed between an inlet (12) for the dispersing system and the orifice nozzle (13). There is a stripping apparatus (17) for the mesh bottom insert. The orifice nozzle (13) is developed as an air atomizer nozzle which is equipped with a compressed gas feed (18), preferably a compressed air feed.

Such first embodiment of the invention also involves a process for spraying dispersive systems in a most finely or very finely distributed form. The process is achieved by means of an apparatus which includes a dispensing head having an orifice nozzle, a die (14) disposed in the inside of the dispensing head and shiftable in front of the orifice nozzle aperture, a mesh bottom (16) disposed between an inlet (12) for the dispersive systems and of the orifice nozzle (13), and a stripping arrangement (17) for the mesh bottom. The dispersive system is sprayed through an air atomizer nozzle whereby the dispersive system is mixed with a pressurized gas, preferably compressed air, in the air atomizer nozzle.

The process and apparatus of the above-described embodiment of the invention provide a uniform spray pattern without the need for excessive throughput of the dispersive material. The dispersed system is sprayed through an air atomizer nozzle. The use of the air atomizer nozzle makes possible a considerable better regulation of the quantity of dispersed system to be sprayed and is particularly suitable to evenly distribute the smallest quantities of material. It has been found that the polymers are capable of limiting the air atomizer nozzle in its action as a result of their film forming characteristics in a continuous operation by the formation of constant deposits. In the case of the nozzle plugging up, the nozzle for the liquid is pierced by a cleaning rod. The film forming polymers are capable of gradually building up deposits, impeding the flow of air and finally interrupting the air flow.

The process and apparatus of a preferred or second embodiment of the invention avoids the above-described disadvantage of the first embodiment of the invention. The second embodiment of the invention provides a process and an apparatus which makes possible a continuous operation free of interruptions during the spraying of polymer-containing suspensions.

The second and preferred embodiment of the invention involves an apparatus for the superfine spraying of dispersive systems, e.g., suspensions, in a superfine form. The apparatus includes a spray or dispensing head having an orifice nozzle. The orifice nozzle forms an air atomizer nozzle which is equipped with a compressed gas feed. A die is disposed inside of the dispensing head and is movable (pushable) in front of the orifice nozzle aperture. A mesh bottom (sieve) insert is disposed between an inlet for the dispersing system and the orifice nozzle. There is a stripping apparatus for the sieve insert. The feed of the pressure gas is equipped with an apparatus for the saturation or oversaturation of the gas.

Preferably a capillary having a diameter of 0.4 to 0.6 mm, most preferably 0.5 mm, is disposed in the piston. Thereby wetted pressure gas flows into the nozzle opening through the pressure gas guide, and when there is a pause in the spraying, by way of the pressure gas connection through the capillary.

Such second or preferred embodiment of the invention involves a process for the superfine spraying of dispersive systems, e.g., suspensions, in a superfine form by means of a pressure gas through the gas atomizer nozzle of spraying apparatus. The apparatus includes a dispensing head having an orifice nozzle. The orifice nozzle forms a spray (gas atomizer) head with a nozzle opening. The spray nozzle is equipped with a compressed gas feed. A die is disposed inside of the dispensing head and is shiftable (pushable) in front of the orifice nozzle aperture. A sieve insert is disposed between an inlet for the dispersive systems and of the orifice nozzle. There is a stripping arrangement for the sieve insert. The process includes spraying the dispersive system through the air atomizer nozzle whereby the dispersive system is mixed with the pressurized gas in the air atomizer nozzle. The dispersive system is preferably a suspension comprised of graphite, water and a film former. The pressure gas is saturated or supersaturated with a liquid.

Preferably the pressure gas is air and the liquid is water. Preferably a solvent miscible with water is used as the liquid. Also, preferably the solvent is an alcohol having 1 to 8 carbon atoms, a glycol, glycol ether or a glycol ether ester. Preferably a mixture of water and the solvent is used as the liquid.

SHORT DESCRIPTION OF THE DRAWINGS

Figure 1:
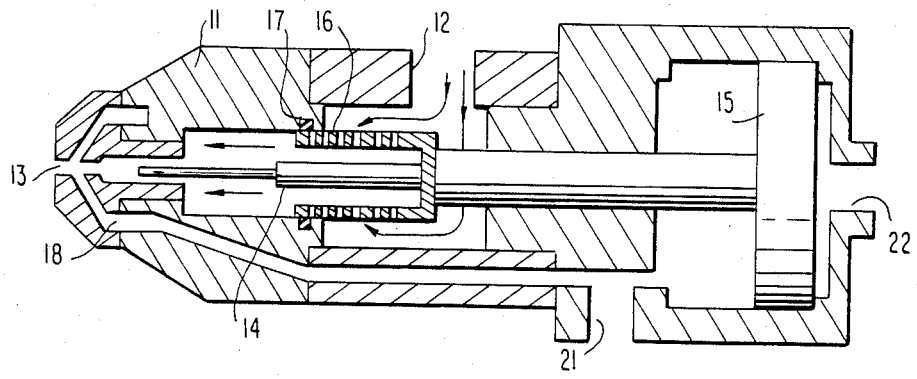
FIG. 1 is a longitudinal cross-sectional view of the first embodiment of the invention.

The invention is explained below in more detail on the basis of the drawings as examples of this invention. The embodiments in the drawings are the preferred embodiments or best mode of this invention.

DETAILED DESCRIPTION OF THE INVENTION

The first embodiment of the invention is described in detail below.

In FIG. 1 the following is shown:

In the housing 11, which is provided with inlet 12 for the dispersive system and at the point of which there is orifice nozzle 13, die 14 has been disposed. Die 14 is movably disposed in a horizontal (longitudinal) direction and is moved by means of piston 15. For example, the control of piston 15 is accomplished pneumatically through pressure gas inlets 21 and 22. A partial stream of the compressed gas comprises compressed gas feed-in 18 to air atomizer nozzle 13.

Mesh bottom 16 effectively has a cylindrical form including the lateral surfaces of the die. Mesh bottom 16 can be attached to piston 15. Stripping apparatus 17 is developed effectively as a hollow cylinder sweeping the outside periphery of mesh bottom 16, which is attached to housing 11, or the stripping apparatus can be developed in the form of a bushing in housing 11. Sealing elements can be used to prevent penetration of the mediae.

Whenever dispersive systems, especially suspensions, are sprayed according to the method of this invention, any solid particles possibly carried along are held back at mesh bottom 16.

A gas, preferably air, which is inert as against the dispersive system, is forced through compressed gas feed line 18 which leads into orifice nozzle 13. The gas can also be nitrogen, $CO_2$, a halohydrocarbon, a noble gas, a mixture of such gases or a mixture of one or more of such gases with air. In front of the orifice nozzle aperture, the gaseous and the essentially fluid medium intermix and exit as a fog from orifice nozzle 13.

Figure 2:
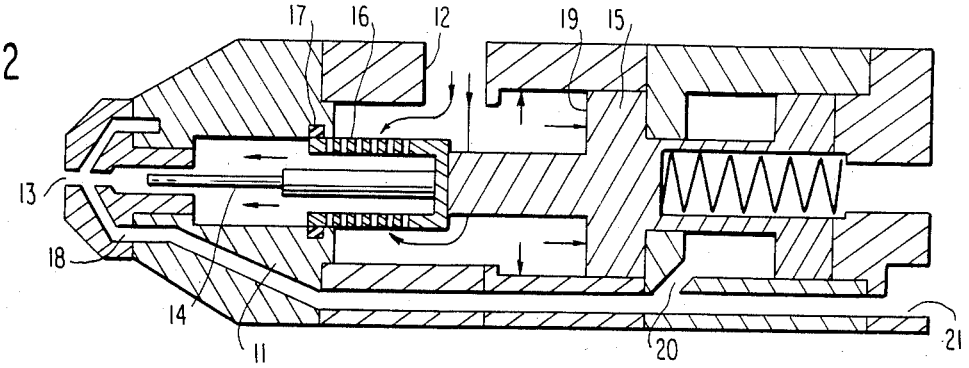
FIG. 2 is a longitudinal cross-sectional view of a modification of the first of the invention embodiment with an additional way of controlling the die.

FIG. 2 shows a further development of the apparatus of the first embodiment of the invention. Piston 15 is made as a tandem piston, which is moved through the pressure of feed-in dispersive system 19, on the one hand, and by a partial stream of compressed gas 20, on the other hand, in the one direction and by spring power in the other direction.

Thus, a wide number of possibilities exist in order to move piston 15. For example, piston 15 can also be moved away from orifice nozzle 13 by means of the pressure of the dispersive system and counter to a spring force. Whenever the pressure of the dispersive system is omitted, piston 15 is returned to its starting position by the spring force. Likewise, piston 15 can be moved by partial streams of the compressed gas or pneumatically by a separate control in one or both directions. Further variations are hydraulic or hydraulic-mechanical control.

Piston 15 moves die 14, attached thereto, first in the direction of opening, i.e., the point of die 14 is withdrawing from the orifice nozzle aperture, and the path for the dispersive system is opened. Whenever piston 15 is moved in the opposite direction, the point or end of die 14 again thrusts into orifice nozzle 13, forces any possible impurities out and closes the orifice nozzle aperture.

Mesh bottom 16 is likewise connected with piston 15 and the surface of sieve 16 is stripped and cleaned during the closing process. In the terminal position the entire surface of sieve 16 is covered up by the bushing 17 or the stripping apparatus, which closes the passageway to the dispersive system. In the case where piston 14 is pulled back, the dispersive system passes through the mesh bottom and any particles which are too large and impurities are held back.

Naturally, the apparatus can also be operated without mesh bottom 16, however, with the disadvantage that its cleaning effect also ceases.

For further development of the apparatus, reference is also made to the doctrine teachings and principle of German OS No. 2,724,931.

The second or preferred embodiment of the invention is described in detail below.

According to the second embodiment of the invention, air is effectively used as the spraying gas and water is effectively used as the liquid.

Above all for reasons of economy, air is normally used, but other inert gases, such as, nitrogen, $CO_2$, a halohydrocarbon or a noble gas alone or mixed with one another or mixed with air, can be used as the spraying gas.

Also for economic considerations, water is normally used as the liquid. However, the liquid can be an alcohol with 1 to 8 carbon atoms, a glycol, glycol ether or a glycol ether ester, alone and mixed with one another or in mixture with water. The liquid can also contain portions of organic, water-soluble oils or an emulsion of oil in water.

The liquid may be admixed into the gas in various ways. For example, where the liquid can be evaporated and allowed to be absorbed by the gas flow, or the liquid can be injected into the gas flow. For this purpose, apparatuses such as dosing pumps, pressure containers with dosing, underpressure dosing means, etc., can be used.

According to the process, the pressure gas must be saturated or oversaturated with liquid. With this, degrees of saturation should also be included which correspond only to an approximate saturation and as they may occur for example as a result of the change of volume and fluctuations in temperature in the pressure gas. In the present case, the term oversaturation not only means an oversaturated state, but also especially includes mist, therefore the liquid is in the form of the tiniest droplets in the pressure gas.

Figure 3:
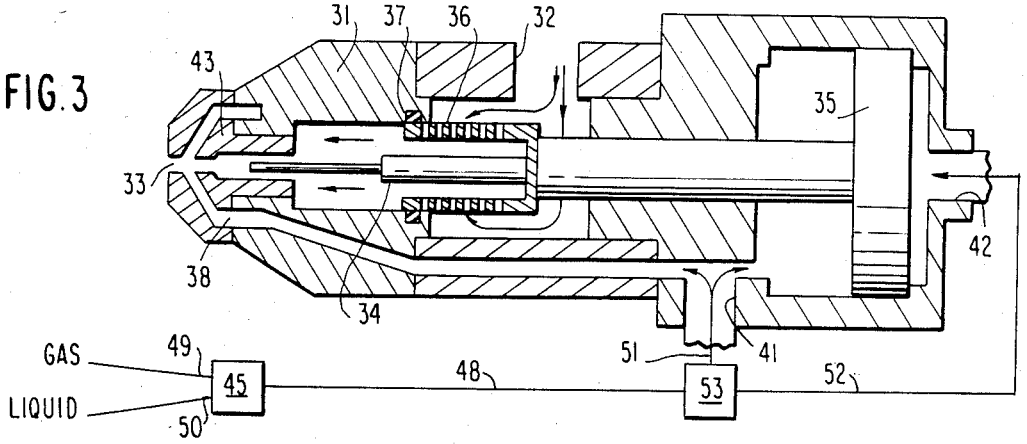
FIG. 3 is a longitudinal cross-sectional view of the second embodiment of the invention.

Referring to FIG. 3, in housing 31, which is equipped with inlet 32 for the suspension and at the top of which there is nozzle opening 33 having a diameter of 1.0 to 4.0 mm, die 34 is located. Die 34 has been disposed moveably in the longitudinal direction and is moved by means of piston 35. By way of example, the control of piston 35 is accomplished pneumatically through pressure gas connection 41 and 42. A partial-stream of the pressure gas constitutes pressure gas feed 38 to air atomizer nozzle 33.

Sieve insert 36 effectively has a cylindrical form encompassing the lateral surfaces of die 34. Sieve insert 36 can be attached to piston 35. Stripping arrangement 37 is made effectively in the form of a hollow cylinder brushing around the outside circumference of sieve insert 36, with such hollow cylinder being attached to housing 31. Or, stripping arrangement 37 can be developed in a bushing in housing 31. Sealing elements can pevent any penetration of the media.

Gas, such as, air, is fed via line 49 into gas saturation unit 45 and liquid, such as, water, is fed via line 50 into gas saturation unit 45. The gas is saturated or oversaturated with the liquid in gas saturation unit 45. The saturated or oversaturated gas is fed via line 48 into the spraying unit via pressurized gas lines 51 and 52 through pressure gas connection 41 and 42 (pressurized gas line 48 is Y-shaped in FIG. 3.). The gas can be pressurized before or after gas saturation line 45. Valve 53, i.e., a 3-way valve, is present in lines 51 and 52 to inlets 41 and 42. When pressurized air flows through line 48 to the intake 41, the piston moves back and opens the spraying system. When the intake 41 is shut and therefore pressureless, the pressure works through opening 42 such that the piston moves backwards and locks the spraying system.

The saturated or oversaturated pressure gas is pressed through pressure gas feed 38 which leads into spray nozzle 33. In front of nozzle opening 33 the saturated or oversaturated pressure gas is mixed with the suspension and the suspension is sprayed as a mist.

Whenever piston 35 moves die 34 attached thereto in the direction away from opening 33, that is to say the tip of die 34 is pulled from nozzle opening 33 and frees the path for the suspension. Whenever piston 35 is moved in the opposite direction, then the tip of the die 34 is again pushed into nozzle opening 33, forcing out any impurities and closing the nozzle opening of the hole. Sieve insert 36 connected with piston 35 is wiped during the closing position, whereby the surface of sieve 36 is cleaned. In the final position, the entire surface of sieve 36 is covered by bushing 37 or the stripping arrangement 37, and it closes the passage for the suspension. When piston 35 is in the retracted position, the suspension passes through sieve insert 36 and any particles and impurities which are too large are held back.

Gas, such as, air, is fed via line 49 into gas saturation unit 45 and liquid, such as, water, is fed via line 50 into air saturation unit 45. The gas is saturated or oversaturated with the liquid in gas saturation unit 45. The saturated or oversaturated gas is fed via 48 into the spraying unit via pressurized gas lines 51 and 52 through pressure gas connections 41 and 42 (pressurize gas line 48 is Y-shaped in FIG. 4). The gas can be pressurized before or after gas saturation line 45. Valve 53, i.e. a 3-way valve, is present in lines 51 and 52 in inlets 41 and 42. When pressurized air flows through line 48 to the intake 41, the piston moves back and opens the spraying system. When the intake 41 is shut and therefore pressureless, the pressure works through opening 42 such that the piston moves backwards and locks the spraying system.

Figure 4:
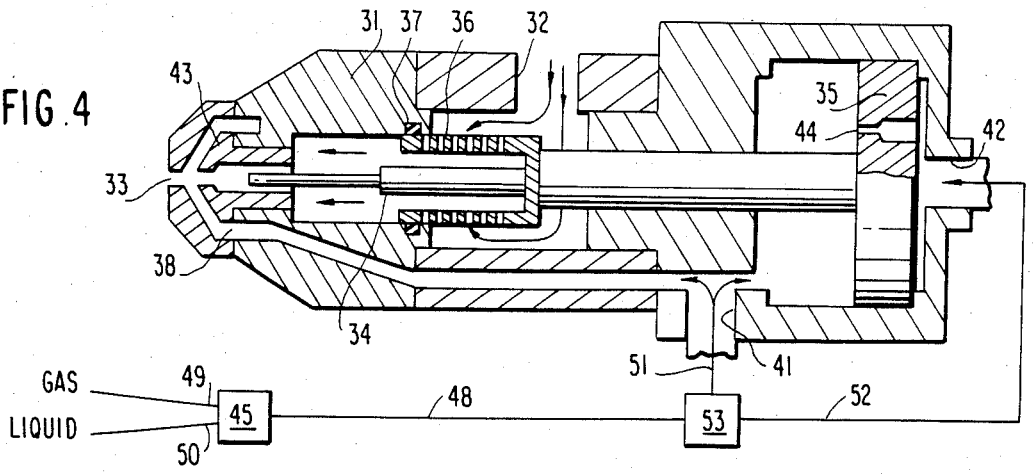
FIG. 4 is a longitudinal cross-sectional view of a modification of the second embodiment of the invention.

In the apparatus of FIG. 4, capillary 44 having a diameter of 0.4 to 0.6 mm, preferably 0.5 mm, is disposed in piston 35. Thereby, when spraying occurs, wetted pressure gas flows by way of pressure gas connection 42 through the capillary 44 and through pressure gas feed 38 into nozzle opening 33. By that system, pressure gas feed 38 is protected from any suspension flowing back and is kept free. Any deposition caused by the drying of remnants of the suspension is reliably prevented and the cleaning of the fine channels of pressure gas feed 38 as well as nozzle opening 33 is achieved.

Naturally, the apparatuses of the invention can also be operated without a sieve insert, but the cleaning effect of the sieve insert is also omitted.

The apparatuses described are used for spraying dispersive systems. In a preferred form, dispersions are sprayed which contain graphite as a dispersive medium, fairly large parts of polymers such as alkyl polymerizates, auxiliary dispersing agents and stabilizers as well as a liquid (normally water) as an dispersing agent. Such formulations have been described in German OS No. 2,450,716 as high-temperature lubricants. In order to be able to use these high-temperature lubricant, in the case of non-cutting rectification of metal, it is necessary to apply them on workpieces and/or tools in a layer and a distribution which are as uniform as possible.

In the first embodiment of the invention, the minimum pressure for the dispersive system, when the apparatus of this invention is used, can be lowered close to atmospheric pressure—advantageously the pressures are from 2.5 bar up to 150 bar. In the second embodiment of the invention, the minimal pressure for the suspension may be lowered close to the atmospheric pressure; pressures of 0.01 up to 15 bar, effectively 0.1 to 0.5 bar, are advantageous. The pressure of the gas must always be somewhat higher than the pressure in the suspension, in order to prevent any back flow of the suspension into the channels of pressure gas feed 18.

As a result of the control of the ratio of quantity of gas to suspension and of the pressure conditions, it will be possible with the apparatus of the second embodiment to spray minimal quantities down to 10 g/min suspension as a most-finely distributed mist without any danger of plugging up the nozzle for very long periods of time.

Instead of a closed film, the dispersive system is deposited in the form of the finest distribution of droplets.

In the case of the use of the process of the invention for the application of high-temperature lubricants, there results a large savings of lubricant dispersion without any change in good lubricating characteristics.

By way of summary, the invention includes a process and apparatus for the spraying of suspensions and other dispersive systems which tend to the formation of a film and to resinification upon contact with air. Examples of such suspensions are the suspensions for spraying high temperature lubricants formulated on a graphite basis with the addition of alkylene polymerizates to a dispersion agent. The invention apparatus has a spray head with a nozzle opening, a die which can be pushed through the nozzle opening and a sieve insert. The suspension is sprayed in the most finely distributed form through an air atomizer nozzle by means of a pressure gas which is oversaturated or saturated with a liquid.

What is claimed is:

1. Apparatus for the superfine spraying of dispersive systems, such as, suspensions, comprised of a spray head with a nozzle mouthpiece developed as a gas atomizer nozzle which is equipped with a pressurized gas feed, the nozzle mouthpiece having a nozzle opening, a die that can be pushed into and out of the nozzle opening which is disposed inside of the spray head, the die is part of a shaft, a sieve insert with a stripping arrangement, which is disposed between an inlet for the dispersed system and the nozzle opening, an apparatus for the saturation or oversaturation of the gas of the pressurized gas feed with a liquid, a chamber located in ther apparatus opposite of the nozzle, the non-die end of the shaft having a piston located in the chamber, there being two inlets for the pressurized gas feed in the apparatus, both inlets communicating with the chamber so as to each enter the camber on different sides of the piston, there being a pressurized gas guide from one of the inlets to the nozzle opening, and a capillary, having a diameter of 0.4 to 0.6 mm, disposed in the piston, whereby wetted pressurized gas flows into the nozzle opening through the pressurized gas guide, and during a pause in the spraying by way of the pressurized gas inlet, is positioned in the chamber on the side of the piston away from the nozzle through the capillary.

2. Apparatus as claimed in claim 1 wherein said pressurized gas feed is a pressurized air feed and saturation is achieved by means of water.

3. Apparatus as claimed in claim 1 wherein said dispersive system includes a material which tends to resinificate in the presence of air.

4. Apparatus as claimed in claim 1 wherein said dispersive system is a suspension.

5. Apparatus as claimed in claim 1 wherein said dispersive system is a suspension comprised of graphite, water and a film former.

* * * * *